US005701882A

United States Patent [19]

Champion

[11] Patent Number: 5,701,882

[45] Date of Patent: Dec. 30, 1997

[54] FIREPLACE WITH CERAMIC FIBER DUCT

[75] Inventor: Mark R. Champion, Huntington, Ind.

[73] Assignee: The Majestic Products Company, Huntington, Ind.

[21] Appl. No.: 573,571

[22] Filed: Dec. 15, 1995

Related U.S. Application Data

[63] Continuation of Ser. No. 202,785, Feb. 28, 1994, abandoned.

[51] Int. Cl.[6] ..... F24B 1/188

[52] U.S. Cl. ..... 126/523; 126/528; 126/77; 126/531

[58] Field of Search ..... 126/528, 77, 83, 126/531, 500, 515, 523; 110/210, 211, 214

[56] References Cited

U.S. PATENT DOCUMENTS

| | | | |
|---|---|---|---|
| 2,497,877 | 2/1950 | Fellows | 126/77 |
| 4,180,052 | 12/1979 | Henderson . | |
| 4,252,105 | 2/1981 | Johnson . | |
| 4,437,451 | 3/1984 | Wysong | 126/77 |
| 4,553,526 | 11/1985 | von Conta | 126/83 X |
| 4,665,889 | 5/1987 | Rumsons et al. | 126/77 |
| 4,672,946 | 6/1987 | Craver | 126/77 |
| 4,773,850 | 9/1988 | Bushman et al. . | |
| 4,856,491 | 8/1989 | Ferguson et al. | 126/77 |
| 5,014,683 | 5/1991 | Wilkening . | |
| 5,244,381 | 9/1993 | Cahlik | 126/116 R |

FOREIGN PATENT DOCUMENTS

| | | | |
|---|---|---|---|
| 3705153 | 9/1988 | Germany | 126/77 |
| 4204752 | 8/1993 | Germany | 126/79 |

*Primary Examiner*—Carl D. Price
*Attorney, Agent, or Firm*—Baker & Daniels

[57] ABSTRACT

A fireplace having a low density ceramic fiber duct with a first duct portion which promotes secondary combustion of unburned products of combustion and a second duct portion which removes products of combustion from the front of the combustion chamber. The ceramic fiber duct is positioned within the fireplace at a location along the flow path of the products of combustion that is intermediate the fireplace combustion chamber and flue. The first ceramic fiber duct portion includes a number of horizontally spaced and longitudinally extending circuitous, internal passageways which define the flow path as well as segregate the products of combustion. Due to their ceramic fiber construction, the passageways heat up quickly to promote secondary combustion of combustion products therein soon after fire ignition. In addition, the passageways are structured such that the combustion products must cover an extended exhaust path, which lengthens their stay within the heated passageways and promotes secondary combustion. The second ceramic fiber duct portion includes a passageway through which combustion products near the front of the combustion chamber can be drawn into a venturi passageway and then exhausted through the flue.

13 Claims, 3 Drawing Sheets

FIREPLACE WITH CERAMIC FIBER DUCT

This is a continuation of application Ser. No. 08/202,785, filed Feb. 28, 1994 abandoned.

BACKGROUND OF THE INVENTION

This invention relates to a combustion apparatus such as a fireplace, and, in particular, to a fireplace with a ceramic structure disposed above the combustion chamber.

When fuel is burned or combusted in a fireplace combustion chamber, products of combustion are created which are ultimately exhausted to the outside atmosphere through a flue. For some fuels, particularly wood but also to an extent fossil fuels, the resulting exhausted products of combustion include a quantity of unburned fuel, which may be in the form of particulate, otherwise known as smoke, or vapor phase organics. Because the heat energy available by combusting these unburned products of combustion is not released before their exhaust from the fireplace, potential heat energy is lost and the fire is less efficient. In addition, the unburned products of combustion are pollutants when introduced into the atmosphere. In order to lessen the amount of unburned products of combustion, the products of combustion should be maintained at temperatures capable of sustaining combustion for longer periods of time during their transport or removal from the combustion chamber.

Existing fireplaces, and in particular the passageways or ducts through which products of combustion are transported, take a finite amount of time to heat up to a steady state condition after a fire is started in the combustion chamber. In conventional zero clearance fireplace designs, these passageways or ducts, even after being heated to steady state, significantly cool the products of combustion passing therethrough. This cooling undesirably hinders further or secondary combustion.

This shortcoming of many existing fireplaces with respect to the completeness of combustion of the products of combustion is especially problematic with respect to fireplaces used for shorter duration fires. For instance, while in some households combustion apparatuses such as zero clearance fireplaces are primarily valued for their ability to provide heat energy to a room or structure and therefore fires are maintained within the combustion chambers for extended periods, in many households the fireplace is operated intermittently and for shorter periods of time, i.e., the heat producing aspect of a fireplace may be ancillary to the enhanced aesthetics resulting from its use. The mesmerizing flames of the fire within the combustion chamber are created to provide a temporary decorative addition to the room, and therefore the fire is extinguished or allowed to die out when the atmosphere is no longer desired. Because the time it takes a fireplace to reach a steady state is generally independent of the time for which the fire will be maintained, a fireplace being used for shorter duration fires will be exhausting undesirable amounts of unburned products of combustion, and therefore be less efficient, a greater proportion of its use time than a fireplace being used for longer duration fires. Thus, it is highly desirable to provide a fireplace with passageways through which products of combustion are conveyed which rapidly heat up to required temperatures when a fire is started in order to provide more complete combustion of the products of combustion sooner than prior art devices.

It is known in the art to utilize ceramics which may to a limited extent promote secondary combustion of the products of combustion relatively shortly after starting of a fire.

However, each suffer from significant shortcomings. For instance, while U.S. Pat. No. 5,014,683 (Wilkening) discloses refractory material firebricks mounted in juxtaposition above the fuel holding grate, the bricks do not appreciably extend the exhaust flow path of the products of combustion, which are free to travel directly upward between these bricks when venting from the combustion chamber.

Moreover, the fireplace disclosed by Wilkening includes a natural draft system with a top vent. Referring to FIG. 3, the flue stack is disposed generally directly above the source of combustion and the flow rate of combustion products is relatively fast through the combustion chamber and flue. The relatively short flow path through the refractory material firebricks, in conjunction with a relatively high velocity flow rate through the refractory material firebricks, may result in an undesirable amount of unburned products of combustion being exhausted from the fireplace and flue to the outside ambient environment.

On the other hand, while conveying products of combustion horizontally rather than vertically, the ceramic grids of U.S. Pat. No. 4,180,052 enclose a linear exhaust path and overall have limited surface area in communication with the hotter combustion chamber which may delay its adequate heating. A shortcoming seemingly shared by both references is a consequence of the high density and brittleness of typical ceramic materials. For example, firebrick typically requires a long time to heat up to a steady state temperature because of its high thermal mass, i.e., thermal storage capacity. Moreover, if struck by a wayward log during the insertion or stacking of fuel in the combustion chamber, or if struck by a blow from a fireplace tool such as a poker, conventional ceramic materials may shatter and fall to the combustion chamber floor. When so shattered, ceramic components no longer function as intended.

What is needed in the art is a fireplace having a ceramic structure which effectively promotes secondary combustion of unburned combustion products.

An additional need is a fireplace having a ceramic structure which when impacted by a foreign object is not permanently deformed to such an extend that the ceramic structure fails to operate at a minimally acceptable level.

SUMMARY OF THE INVENTION

The present invention provides a fireplace having a low density ceramic duct which is disposed between the combustion chamber and flue, and defines an extended flow path for the products of combustion to promote secondary combustion of unburned products of combustion.

In one form thereof, the fireplace of the present invention includes a combustion chamber, a flue, and a ceramic fiber duct. The combustion chamber, whereat fuel is combusted and products of combustion are created, includes an opening through which combustion air is introduced to allow combustion. The flue is positioned to exhaust the products of combustion. The ceramic fiber duct is positioned within the fireplace at a location along the flow path of the products of combustion that is intermediate the combustion chamber and the flue. The ceramic fiber duct, which promotes additional combustion of unburned products of combustion, includes a products of combustion inlet, a products of combustion outlet, and at least one internal passageway connecting the inlet and outlet. The passageway defines the flow path for the products of combustion. The ceramic fiber material, due to its relatively low density, is heated very rapidly by the products of combustion so that the temperatures necessary to achieve secondary combustion can be realized shortly after the fire is started. A further advantage to the ceramic fiber material is that it is able to be cast easily into a variety of complex shapes.

In another form thereof, the fireplace of the present invention includes a combustion chamber whereat fuel is combusted and products of combustion are created. The combustion chamber includes an opening through which combustion air is introduced. The fireplace includes a flue positioned to exhaust the products of combustion. The fireplace also includes a ceramic duct, positioned intermediate the combustion chamber and the flue, for extending the exhaust travel path of the products of combustion to promote additional combusting of unburned products of combustion. This ceramic duct has a products of combustion inlet, a products of combustion outlet, and at least one circuitous passageway connecting the inlet and outlet.

In still another embodiment thereof, the fireplace of the present invention includes a combustion chamber, a flue, and a ceramic duct. Fuel is combusted and products of combustion are created in the combustion chamber, which includes an opening through which combustion air is introduced and a width having a central portion and lateral portions. The products of combustion generally have a higher heat content at the central width portion of the combustion chamber than at the lateral width portions of the combustion chamber. The flue is positioned for exhausting the products of combustion. The ceramic duct, positioned intermediate the combustion chamber and the flue, extends the exhaust travel path of the products of combustion to promote additional combusting of unburned products of combustion. The ceramic duct includes a products of combustion inlet, a products of combustion outlet, and a plurality of horizontally spaced and longitudinally extending passageways connecting the inlet and outlet. The plurality of passageways allow the products of combustion which rise upward from the central width portion of the combustion chamber to enter passageways different than those passageways into which products of combustion from the lateral width portions of the combustion chamber enter, thereby segregating the hotter products of combustion from the cooler products of combustion during their exhaust from the combustion chamber so that cooling is limited.

In another embodiment thereof, the fireplace of the present invention includes a combustion chamber, a flue, a ceramic duct, and a venturi passageway. Fuel is combusted and products of combustion are created in the combustion chamber, which includes an opening through which combustion air is introduced. The flue is positioned for exhausting the products of combustion. The ceramic duct, positioned intermediate the combustion chamber and flue, removes products of combustion from the front of the combustion chamber. The ceramic duct includes a products of combustion inlet, a products of combustion outlet, and a passageway connecting the inlet and outlet. The venturi passageway, disposed intermediate the ceramic duct and flue along the combustion products flow path, includes an entry aperture within a low pressure region. The entry aperture is located within the fireplace at a position proximate the products of combustion outlet such that products of combustion are drawn through the ceramic duct passageway.

An advantage of the ceramic fiber duct of the present invention is that it promotes secondary combustion shortly after ignition of the fire due to its rapid heating characteristics.

Another advantage of the present invention is that secondary combustion is further promoted because the products of combustion, during exhaust from the combustion chamber, must pass through an extended flow path which is rapidly heated after fire ignition.

Yet another advantage of the present invention is that the design and location of the ceramic fiber duct serves to minimize the direct mixing of cool inlet air with the products of combustion. Such reduction of dilution with room air improves combustibility and maintains higher temperatures in the combustion product flow.

Still another advantage is that the ceramic fiber duct of the present invention is sufficiently durable to withstand some accidental blows from objects introduced within the combustion chamber without breaking or otherwise becoming inoperational.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENT

Figure 1:
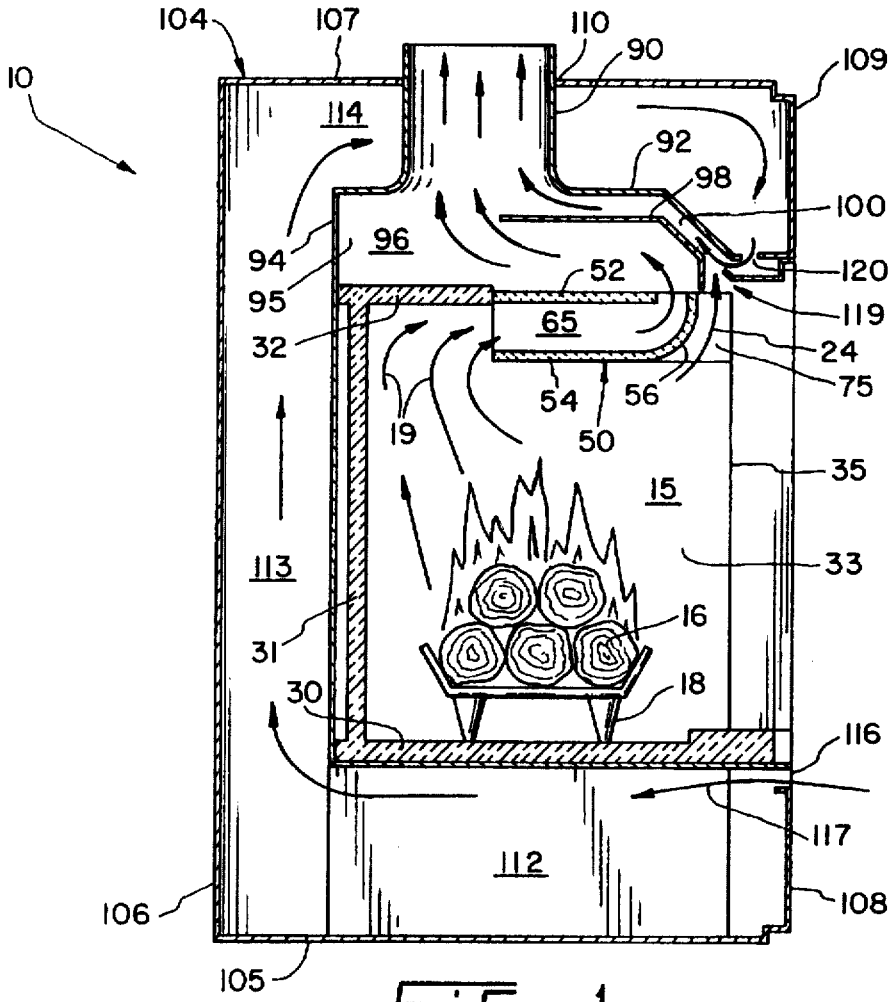
FIG. 1 is a side sectional view of an embodiment of the present invention showing a zero clearance fireplace including a ceramic fiber duct of the present invention.

Referring now to FIG. 1, there is shown in cross-sectional view of an embodiment of the present invention, wherein a fireplace, generally designated 10, includes a ceramic dual duct, generally designated 50. While fireplace 10 is shown and further explained herein with reference to a zero clearance, wood-burning fireplace product, the described embodiment is merely illustrative of one type of beneficial application of the present invention. The teachings of the present invention are envisioned finding useful application with other fireplace units, for instance gas appliances, where the improved secondary combustion feature provided by the ceramic duct is beneficial.

Fireplace 10 includes a central combustion chamber 15 in which the fuel or wood logs 16 are stacked in grate 18 and combusted to create products of combustion. Grate 18 is typically located at the center of the side-to-side width of combustion chamber 15. The initial flow path of these combustion products out of combustion chamber 15 is indicated generally by upward arrows 19 within chamber 15. Combustion chamber 15 is bounded by a frontal surface which is actually an opening 35, as well as a bottom wall or floor 30, a rear wall 31, a top wall or ceiling 32, a far side wall 33, and an opposing side wall 34 (not shown) made of refractory materials. Opening 35 allows combustion air to be introduced or enter into combustion chamber 15 from the room in which fireplace 10 is installed. Additional fuel 16 can also be added to grate 16 via opening 35. Although not shown herein, any of a number of closure devices well known in the art, including a standard set of openable glass doors, can be interposed between opening 35 and the fireplace room.

Top wall 32 extends the full width of combustion chamber 15 near its rear region. Positioned forward of the rear region of top wall 32 is ceramic duct 50, which is inserted in an appropriately sized aperture in top wall 32. Ceramic duct 50 is positioned directly above the central and forward regions of combustion chamber 15. Ceramic duct 50 includes an upper baffle 52 which abuts top wall 32. As shown in FIG. 1, upper baffle 52 is preferably disposed in a generally coplanar relationship with top wall 32. Ceramic duct 50 also includes a lower baffle 54 which is positioned in spaced apart relationship with upper baffle 52, and protrudes into combustion chamber 15 below top wall 32 and between opposing side walls 33, 34.

Located above and in fluid communication with combustion chamber 15 and ceramic duct 50 is a vertical flue 90 through which the products of combustion are ultimately exhausted to the outside atmosphere. Vertical flue 90 extends from a forward angled baffle 92 and a rearward baffle 94. Baffles 92, 94 stretch the width of combustion chamber 15 and laterally terminate at side walls, one of which is referenced 95, which upwardly extend above combustion chamber side walls 33, 34. Forward angled baffle 92, rearward baffle 94, side wall 95 and the opposing side wall define a chamber 96. Double angled diverter plate 98 is disposed within chamber 96 at a position beneath and in spaced apart relationship with forward angled baffle 92. Diverter plate 98 is particularly structured and placed proximate angled baffle 92 to create venturi passageway 100 within chamber 96.

An outer shell or housing 104 of interconnected steel plates essentially encloses the combustion chamber 15 as well as the products of combustion exhaust conduits. Housing 104 includes front plate portions 108, 109, bottom plate 105, rear plate 106, top plate 107, and side plates (not shown). Housing top plate 107 includes an aperture 110 through which flue 90 upwardly extends. Housing plates 105–107 are spaced from combustion chamber 15 and the exhaust conduits to form a lower plenum 112, a rear plenum 113, and an upper plenum 114, which fluidly communicate to provide a generally C-shaped air flow path. The housing side plates flanking combustion chamber sides 33, 34 and the conduit side walls may also be spaced therefrom to form side plenums (not shown) in fluid communication with plenums 112–114.

A series of individual inlets 116, for instance directly above or formed in front plate portion 108, extend approximately the forward width of housing 104. Inlets 116 allow room air, as indicated by arrow 117, to enter lower plenum 112. A downwardly opening outlet 120, extending the forward width of combustion chamber 15, allows air which has traveled through the plenums surrounding chamber 15 to exit from within top plenum 114. Outlet 120 is defined by the lower, rearwardly extending edge of front plate portion 109 and the forward end of angled baffle 92. Outlet 120 is positioned proximate the inlet or entry aperture to venturi passageway 100 and forward of the second duct portion of ceramic duct 50.

Figure 2:
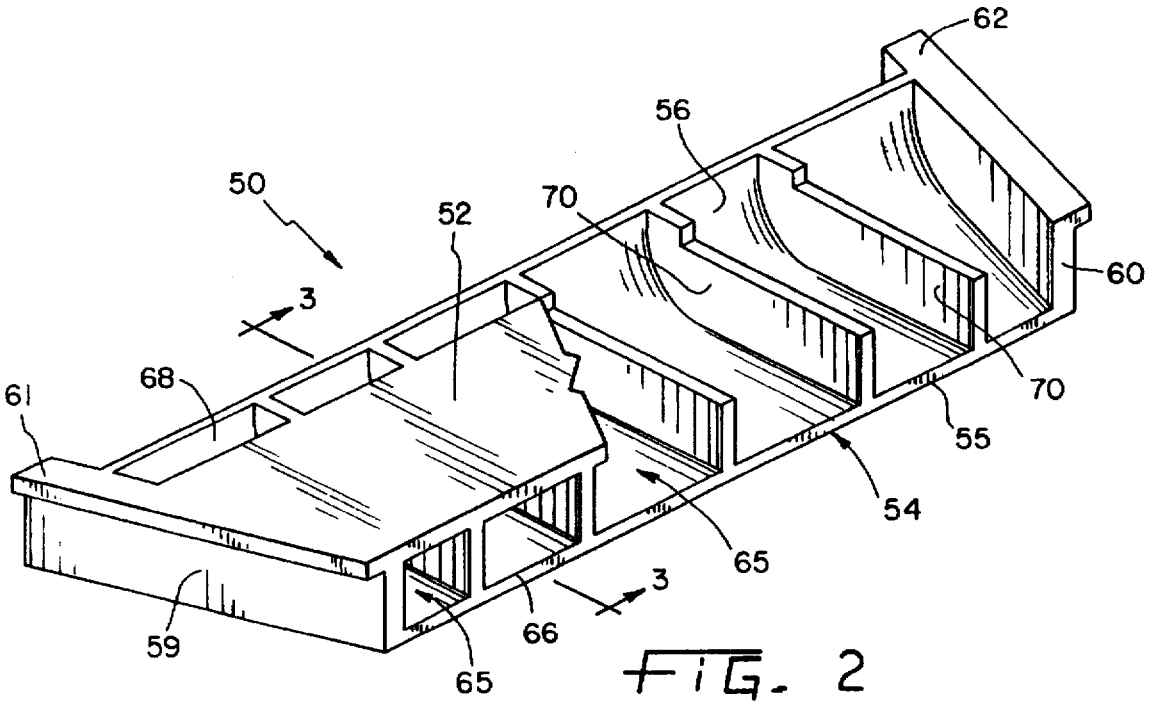
FIG. 2 is a fragmentary perspective view of the ceramic fiber duct of FIG. 1 removed from the balance of the fireplace, wherein a portion of the upper baffle is removed to illustrate the duct internal passageways.
Figure 3:
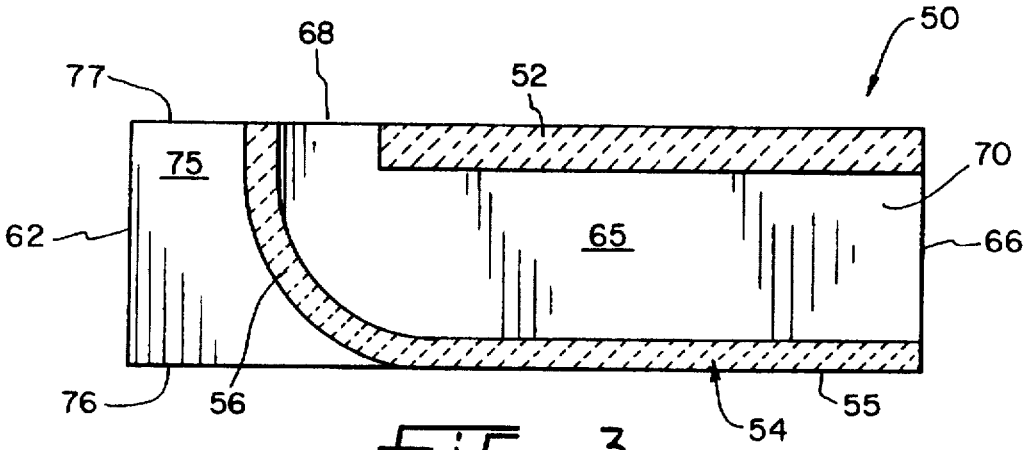
FIG. 3 is a cross-sectional view of the ceramic fiber duct taken along line 3—3 of FIG. 2.
Figure 4:
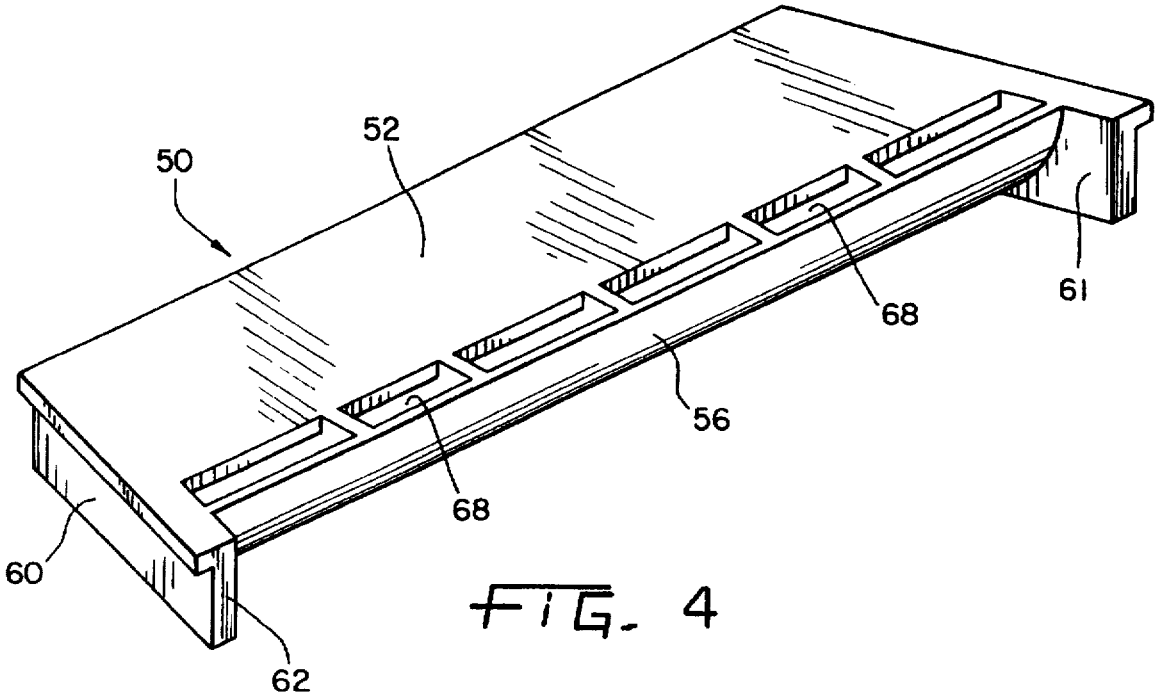
FIG. 4 is a front perspective view of the ceramic fiber dual duct of FIG. 2.

The construction of ceramic duct 50 will now be further explained with reference to FIGS. 2–4. Ceramic duct 50 preferably extends the entire width of combustion chamber 15, as the generally trapezoidal horizontal cross section of dual duct 50 is a function of the angling of combustion chamber side walls 33, 34. Lower baffle 54 includes a generally planar rearward region 55 and an arcuate forward region 56. Upper baffle 52 is spaced from and parallel to the straight rearward region of lower baffle 54. The lateral regions of baffles 52, 54 are bounded by inverted L-shaped side members 59, 60, which include forward extensions 61, 62 that jut beyond the lower baffle arcuate forward region 56. Horizontal legs 63, 64 of inverted L-shaped side members 59, 60 provide overhangs to allow dual duct 50 to be supported thereat by contact with walls of combustion chamber 15. A number of vertical, parallel divider plates 70, spanning the gap between upper baffle 52 and lower baffle 54 along their entire lengths, are horizontally spaced and longitudinally extend along the width of dual duct 50. Various numbers of divider plates 70 can be provided by the manufacturer to provide as many internal passageways, i.e., independent secondary combustion zones, as experimentally determined to be desirable.

The space formed between lower baffle 54, upper baffle 52, and side members 59, 60 and divider plates 70 define internal passageways 65, which in turn define respective flow paths for the combustion products. Passageways 65 are the first duct portion of ceramic duct 50 and, as described more fully below, serve to promote additional combustion of unburned products of combustion therein. Although the illustrated embodiment discloses six horizontally spaced and longitudinally extending passageways 65, other embodiments can employ additional or as few as one passageway 65. Combustion products enter the internal passageways 65 via a vertically disposed inlet 66 which stretches the entire rearward width of dual duct 50. Inlet 66 opens rearwardly into the upper rearward region of combustion chamber 15. Products of combustion are exhausted from passageways 65 through a horizontally disposed outlet 68. It will be appreciated that the shape of baffles 52, 54 results in internal passageways 65 being circuitous in form, thereby further extending the exhaust flow path of the products of combustion such that the products remain within the respective heated passageways 65 for a longer duration.

Ceramic duct 50 also includes a second duct portion positioned toward the front of combustion chamber 15. The second duct portion removes products of combustion from the front of the combustion chamber. In particular, a substantially vertically passageway 75 with inlet 76 and outlet 77 is positioned forward of the arcuate forward region 56 of lower baffle 54 and laterally between forward extensions 61, 62. The anterior portion of passageway 75 is preferably unbounded, as such a component would serve limited function in routing combustion products in view of the flow properties of the present invention described below.

Ceramic duct 50 is fabricated from a ceramic material which has a relatively low thermal mass. Due to this low thermal mass, ceramic duct 50 heats up quickly upon exposure to higher temperature products of combustion. Ceramic duct 50 is preferably made from a ceramic fiber material having a density of about 21 lbs per cubic foot, such as Pyrolite™, Mix No. 3300, available from Rex Roto of Fowlerville, Mich. In addition to possessing rapid heating characteristics, this ceramic fiber provides ceramic duct 50 with durability sufficient to provide adequate operation when accidental blows are received incident to normal operations of fireplace 10. The ceramic fiber material can be cast in a variety of shapes, thereby lending itself to complex structures, such as ceramic duct 50. This ceramic fiber material has a density range of 15 to 50, however is preferably used at 15 to 30, lbs per cubic foot, rather than a higher density associated with some other ceramic or cement materials in the range of around 100 lbs per cubic foot. Moreover, this ceramic material preferably has a thermal conductivity of about 0.85 (btu * in)/(hr * $ft^2$ *° F.) at 1200° F. Ceramic duct 50 is also preferably formed in a monolithic or one-piece construction, which, for example, better ensures the integrity of internal passageways 65, using casting methods known in the art.

A further understanding of the present invention will result from an explanation of its operation. When a fire is desired to be started and maintained in combustion chamber 15, fuel 16 is provided in grate 18. In the illustrated embodiment, the combustion air necessary for the combustion of fuel 16 passes through opening 35 after passing through either the opened closure device or through apertures known in the art provided in the closure device. It will be appreciated that the combustion air opening or inlet shown is merely an example and is not intended to limit the scope of the invention. For instance, the present invention may operate with combustion air entering chamber 15 through other openings, for example openings in other walls of combustion chamber 15, connected by conduits to either room air or an outside air source.

After the fuel is ignited, the fuel begins to burn or combust and generate products of combustion. The products of combustion, including a limited amount or unburned particulates, are hot relative to the combustion air and begin to rise as indicated by the arrows in chamber 15. Rather than a direct upward route to a location of exhaust from combustion chamber 15, the combustion products are routed by ceramic duct 50 through an extended travel path. Most of the combustion products enter the first duct portion of ceramic duct 50 through inlet 66. The products of combustion then continue forward through the individual internal passageways 65, which preferably extend in a longitudinal direction a substantial portion of the depth of chamber 15. The lower baffle arcuate forward region 56 causes the products of combustion within internal passageway 65 to travel a circuitous exhaust path, further extending the length of the exhaust travel path. The divider plates 70 in ceramic duct 50 provide greatly increased surface area which is heated by the combustion gases and further promotes the secondary combustion occurring in ceramic duct 50. In addition, arcuate forward region 56 provides an additional amount of quickly heated ceramic fiber surface to promote secondary combustion by thermal contact with the combustion products. More circuitous ceramic fiber surfaced passageways, for example one which doubles back above passageway 65, are also possible.

Due to the ceramic fiber construction of ceramic duct 50, the duct surfaces defining passageways 65 are rapidly heated by products of combustion which have previously passed therethrough. In addition, the heat and combustion products radiating from the fire will also heat the duct, at the underside of baffle 54, through pan 37. Consequently, soon after fire ignition internal passageways 65 will experience high temperatures, which will promote secondary combustion of the products of combustion to occur therein. It will be appreciated that because of the materials of construction of duct 50, the first duct portion will achieve temperatures at which secondary combustion can occur prior to the time conventional fireplace ducts could promote secondary combustion.

Further enhancing secondary combustion is the segregating of the products of combustion introduced to ceramic duct 50 achieved through divider plates 70. In particular, the intensity of the fire typically varies along the width of the combustion chamber 15, with the products of combustion which rise from the burning fuel in the central width portion of chamber 15 generally having a higher temperature and heat content than the combustion products at the lateral width portions. When the products of combustion reach inlet 66, the hotter central products enter the central internal passageways 65, while the cooler lateral combustion products enter the flanking passageways 65. Because the cooler products are segregated from the hotter combustion products, the products do not intermix, which would cause the aggregate products to reach a middle temperature at which combustion of unburned products is less likely to occur. Consequently, the unburned particulates in the central, hotter products of combustion do not undergo cooling caused by encountering cooler combustion products and therefore are more likely to experience secondary combustion in the central internal passageways 65. Now more fully combusted, the products of combustion exit the first duct portion via outlet 68, are routed rearwardly by diverting plate 98, and are exhausted to the outside atmosphere through flue 90.

Not all the products of combustion pass through the internal passageways 65 of first duct portion. Instead, some combustion products roll toward the front of combustion chamber 15. To prevent these products of combustion from passing through combustion chamber opening 35 and into the heated room, these products are drawn through passageway 75. During operation, room air enters lower plenum 112 through inlets 116, sequentially proceeds through rear plenum 113 and upper plenum 114 and passes out outlet 120. Fluids are drawn through venturi passageway 100 and create a low pressure region at its entry aperture, which is located proximate both room air outlet 120 and outlet 77 of passageway 75. Consequently, products of combustion at arrow 24 are found to be drawn through venturi passageway 100 and exhausted to the atmosphere through flue 90. Similarly, room air circuited around combustion chamber 15 and passed through outlet 120 is drawn rearwardly, as indicated by arrow 119, into venturi passageway 100 and ultimately out flue 90. This rearward redirecting of the room air is believed to aid in keeping the combustion products such as smoke at arrow 24 from rolling into the heated room.

Figure 5:
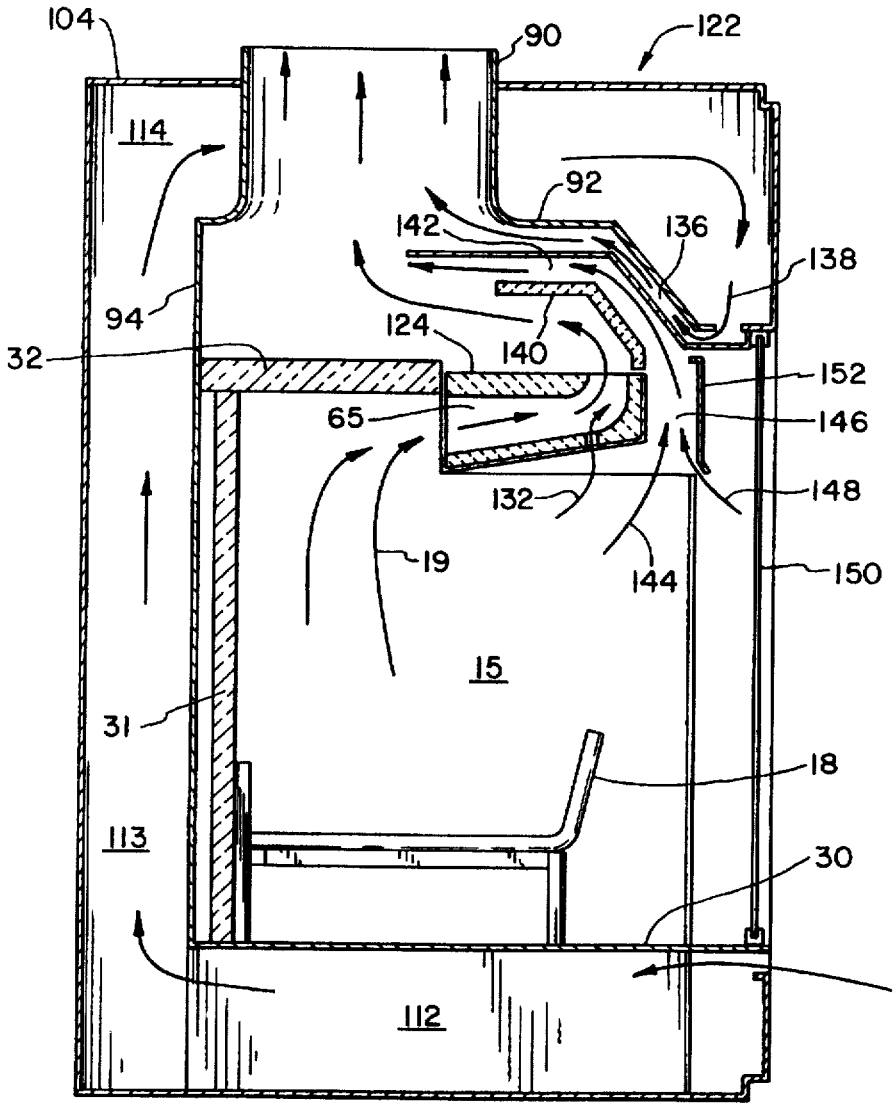
FIG. 5 is a side sectional view of another embodiment of the present invention.
Figure 6:
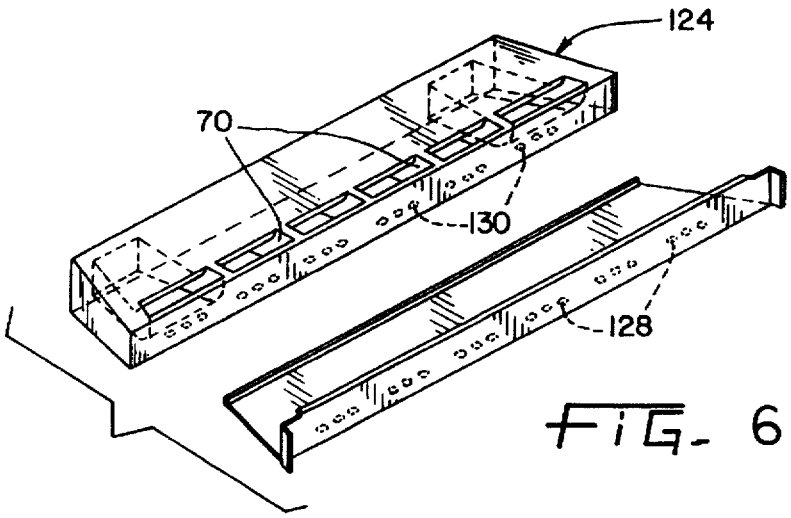
FIG. 6 is a perspective view of the ceramic fiber duct and protective pan shown in FIG. 5.

FIGS. 5 and 6 disclose another embodiment of the present invention. Similar to fireplace 10 shown in FIGS. 1–4, fireplace 122 includes a combustion chamber 15 defined in part by a floor 30, rear wall 31 and top wall 32. Disposed exterior of combustion chamber 15 and interior of housing 104 is a lower plenum 112, rear plenum 113 and upper plenum 114. A ceramic duct disposed at the top of combustion chamber 15 similarly defines a plurality of passageways 65 separated by divider plates 70. However, disposed below ceramic duct 124 is a metal pan 126 which acts to protect ceramic duct 124 from contact with fuel being loaded into the fireplace, a poker, etc. Ceramic duct 124 is comprised of a ceramic fiber material such that contact by a poker or the like will not result in complete fracture of ceramic duct 124. However, it may be possible that a poker or other object would poke a hole through ceramic duct 124, and thereby decrease the operating efficiency of ceramic duct 124. Metal pan 126 thus acts to protect ceramic duct 124.

Moreover, each of ceramic duct 124 and metal pan 126 include a plurality of aligned holes 128, 130 which allow passage of secondary combustion air, indicated generally by directional arrow 132, into each of chamber 65 for effecting more complete secondary combustion therein.

A first diverter plate 134 is disposed generally parallel to and spaced apart from forward angled baffle 92. An air passageway 136 is defined between forward angled baffle 92 and first diverter plate 134, and receives a flow of heated room air which is circulated through upper plenum 114 as indicated by directional arrow 138. Air flowing through air passageway 136 mixes with combustion products at the entrance to flue 90.

A second diverter plate 140 is disposed generally spaced apart from and parallel to first diverter plate 134. A venturi passageway 142 is defined by and disposed between first diverter plate 134 and second diverter plate 140. Any combustion products which are not drawn into passageways 65 of ceramic baffle 50 and which spill out towards the front of fireplace 122, as indicated by arrow 144, flow upward through a second duct 146 and into venturi passageway 142. Additionally, some combustion air, as indicated by arrow 148, flows through cracks between adjacent glass doors, one of which is referenced 150, and into venturi passageway 142, via second duct 146. The mixture of combustion products and combustion air which exits from venturi passageway 142 mixes with combustion products at the entrance to flue 90.

Disposed between ceramic duct 124 and door 150 is a vertical plate 152 which in part defines second duct 146.

While this invention has been described as having a preferred design, the present invention may be further modified within the spirit and scope of this disclosure. For instance, ceramic fiber dual duct 50 could utilize a sloped linear internal passageway 65 or passageways, rather than a circuitous path, to remove combustion products from the combustion chamber 15. Ceramic duct 50 could also be raised relative to chamber 15 such that lower baffle 54 would be coplanar with top wall 32, with inlet 66 essentially opening downwardly into the rear regions of chamber 15. This application is therefore intended to cover any variations, uses, or adaptations of the invention using its general principles. Further, this application is intended to cover such departures from the present disclosure as come within known or customary practice in the art to which this invention pertains.

What is claimed is:

1. A fireplace for combusting fuel comprising:

a combustion chamber whereat the fuel is combusted and products of combustion are created, said combustion chamber comprising an opening through which combustion air is introduced;

a flue positioned in a first direction from said combustion chamber for exhausting the products of combustion; and a ceramic fiber duct, positioned directly above said combustion chamber and below said flue, for promoting additional combusting of unburned products of combustion, said ceramic fiber duct comprising a products of combustion inlet, a products of combustion outlet, and at least one internal passageway connecting said inlet and said outlet and defining a flow path for the products of combustion, wherein along at least a portion of its length said internal passageway is defined by surfaces consisting of ceramic fiber in direct contact with the products of combustion, and wherein at least a segment of said at least one internal passageway is arranged such that said flow path defined thereby is oriented at an angle from said first direction, said ceramic fiber duct comprising a lower baffle defining at least a portion of the bottom of said at least one internal passageway, and wherein said duct is positioned above said combustion chamber such that said lower baffle is exposed within said combustion chamber to be heated by the products of combustion.

2. A fireplace for combusting fuel comprising:

a combustion chamber whereat the fuel is combusted and products of combustion are created, said combustion chamber comprising an opening through which combustion air is introduced;

a flue positioned in a first direction from said combustion chamber for exhausting the products of combustion; and a ceramic fiber duct positioned intermediate said combustion chamber and said flue, for promoting additional combusting of unburned products of combustion, said ceramic fiber duct comprising a products of combustion inlet, a products of combustion outlet, and at least one internal passageway connecting said inlet and said outlet and defining a flow path for the products of combustion, wherein along at least a portion of its length said internal passageway is defined by surfaces consisting of ceramic fiber in direct contact with the product of combustion, and wherein at least a segment of said at least one internal passageway is arranged such that said flow path defined thereby is oriented at an angle from said first direction, said ceramic fiber duct comprising a lower baffle defining at least a portion of the bottom of said at least one internal passageway, wherein said duct is positioned above said combustion chamber, wherein said combustion chamber comprises a top wall and opposing side walls, and wherein said lower baffle protrudes into said combustion chamber below said top wall and between said opposing side walls.

3. The fireplace of claim 2 wherein said ceramic fiber duct comprises an upper baffle in spaced apart relationship with said lower baffle, said upper baffle defining at least a portion of the top of said at least one internal passageway.

4. A fireplace for combusting fuel comprising:

a combustion chamber whereat the fuel is combusted and products of combustion are created, said combustion chamber comprising an opening through which combustion air is introduced;

a flue positioned for exhausting the products of combustion; and a ceramic fiber duct, positioned intermediate said combustion chamber and said flue, for promoting additional combusting of unburned products of combustion, said ceramic fiber duct comprising a products of combustion inlet, a products of combustion outlet, and at least one internal passageway connecting said inlet and said outlet and defining a flow path for the products of combustion, said combustion chamber comprising a back portion and a front portion, wherein said front portion is disposed forward of said back portion whereby said front portion is intermediate said combustion chamber back portion and an interior of a room in which the fireplace is located when installed, the fireplace further comprising a second ceramic fiber duct for removing products of combustion from the front portion of said combustion chamber, said second ceramic fiber duct positioned forward of said at least one internal passageway.

5. A fireplace for combusting fuel comprising:

a combustion chamber whereat the fuel is combusted and products of combustion are created, said combustion chamber comprising an opening through which combustion air is introduced;

a flue positioned for exhausting the products of combustion;

a low density ceramic duct positioned intermediate said combustion chamber and said flue, said ceramic duct comprising a products of combustion inlet, a products of combustion outlet, and at least one circuitous passageway connecting said inlet and said outlet for extending the exhaust travel path of the products of combustion between said combustion chamber and said flue to promote additional combusting of unburned products of combustion, wherein said duct comprises a lower baffle, an upper baffle, and sides respectively defining at least a portion of the bottom surface, top surface and side surfaces of said at least one passageway, and wherein along at least a segment of said at least one passageway said lower baffle and said sides each comprise ceramic in direct contact with the products of combustion, said lower baffle is positioned above said combustion chamber, wherein said lower baffle comprises an arcuate forward region defining an upward bend in said at least one circuitous passageway.

6. The fireplace of claim 5 wherein said lower baffle transversely extends at least a portion of the width of said combustion chamber, and wherein said ceramic duct comprises a plurality of longitudinal divider plates horizontally spaced apart along an upper surface of said lower baffle, said divider plates defining the sides of a plurality of circuitous passageways.

7. A fireplace for combusting fuel comprising:

a combustion chamber whereat the fuel is combusted and products of combustion are created, said combustion chamber comprising an opening through which combustion air is introduce;

a flue positioned for exhausting the products of combustion;

a low density ceramic duct positioned intermediate said combustion chamber and said flue said ceramic duct comprising a products of combustion inlet, a products of combustion outlet, and at least one circuitous passageway connecting said inlet and said outlet for extending the exhaust travel path of the products of combustion between said combustion chamber and said flue to promote additional combusting of unburned products of combustion, wherein said duct comprises a lower baffle, an upper baffle, and sides respectively defining at least a portion of the bottom surface, top surface and side surfaces of said at least one passageway, and wherein along at least a segment of said at least one passageway said lower baffle and said sides each comprise ceramic in direct contact with the products of combustion, said combustion chamber comprises a back portion and a front portion, wherein said front portion is disposed forward of said back portion whereby said front portion is intermediate said combustion chamber back portion and an interior of a room in which the fireplace is located when installed, the fireplace further comprising a second ceramic duct for removing products of combustion from the front portion of said combustion chamber, said second ceramic duct positioned forward of said at least one circuitous passageway.

8. A fireplace for combusting fuel comprising:

a combustion chamber whereat the fuel is combusted and products of combustion are created, said combustion chamber further comprising an opening through which combustion air is introduced and a width having a central portion and lateral portions, wherein the products of combustion generally have a different heat content at the central width portion than at the lateral width portions;

a flue positioned in a first direction from said combustion chamber for exhausting the products of combustion;

a ceramic duct, positioned intermediate said combustion chamber and said flue, for extending the exhaust travel path of the products of combustion to promote additional combusting of unburned products of combustion, said ceramic duct comprising a products of combustion inlet, a products of combustion outlet, and a plurality of horizontally spaced and longitudinally extending passageway connecting said inlet and said outlet and segregating the products of combustion, wherein said passageways are separated by generally vertically arranged divider plates comprising ceramic, wherein at least a segment of each of said passageways is oriented at an angle from said first direction, whereby the products of combustion from the central width portion of said combustion chamber enter at least one of said passageways and are thereby segregated from the products of combustion from the lateral width portions of said combustion chamber that enter other of said passageways, said combustion chamber comprising a back portion and a front portion, wherein said front portion is disposed forward of said back portion whereby said front portion is intermediate said combustion chamber back portion and an interior of a room in which the fireplace is located when installed, the fireplace further comprising a second ceramic duct for removing products of combustion from the front portion of said combustion chamber, said second ceramic duct positioned forward of said plurality of horizontally spaced and longitudinally extending passageways.

9. A fireplace for combusting fuel comprising:

a combustion chamber whereat the fuel is combusted and products of combustion are created, said combustion chamber further comprising an opening through which combustion air is introduced, wherein said combustion chamber further comprises a back portion and a front portion, wherein said front portion is disposed forward of said back portion whereby said front portion is intermediate said combustion chamber back portion and an interior of a room in which the fireplace is located when installed;

a flue positioned for exhausting the products of combustion;

a first duct, positioned intermediate said combustion chamber and said flue, for removing products of combustion from the back portion of said combustion chamber, said first duct comprising a ceramic construction and a products of combustion inlet, a products of combustion outlet, and a passageway connecting said inlet and said outlet;

a second duct, disposed forward of said ceramic first duct and positioned intermediate said combustion chamber and said flue, for removing products of combustion from the front portion of said combustion chamber, said second duct comprising a products of combustion inlet, a products of combustion outlet, and a passageway connecting said inlet and said outlet; and a venturi passageway disposed intermediate said second duct and said flue along the combustion products flow path, said venturi passageway comprising an entry aperture within a low pressure region at an upstream end through which combustion products and room air are introduced, wherein said entry aperture is positioned proximate said second duct products of combustion outlet such that products of combustion are drawn through said second duct passageway and into said venturi passageway.

10. The fireplace of claim 9 wherein said fireplace further comprises a combustion chamber housing including a top shell member, and a plenum disposed between said top shell member and said combustion chamber and through which room air passes, said plenum comprising an air outlet forward of said entry aperture, wherein said entry aperture is positioned proximate said air outlet such that air is drawn rearwardly therefrom and into said venturi passageway.

11. A fireplace for combusting fuel comprising:

a combustion chamber whereat the fuel is combusted and products of combustion are created, said combustion chamber comprising an opening through which combustion air is introduced, wherein said combustion chamber comprises a back portion and a front portion, wherein said front portion is disposed forward of said back portion whereby said front portion is intermediate said combustion chamber back portion and an interior of a room in which the fireplace is located when installed;

a flue positioned for exhausting the products of combustion;

a ceramic fiber duct, positioned intermediate said combustion chamber and said flue, for promoting additional combusting of unburned products of combustion, said ceramic fiber duct comprising a products of combustion inlet, a products of combustion outlet, and at least one internal passageway connecting said inlet and said outlet and defining a flow path for the products of combustion; and a second ceramic fiber duct for removing products of combustion from the front portion of said combustion chamber, said second ceramic fiber duct positioned forward of said at least one internal passageway.

12. A fireplace for combusting fuel comprising:

a combustion chamber whereat the fuel is combusted and products of combustion are created, said combustion chamber comprising an opening through which combustion air is introduced, wherein said combustion chamber comprises a back portion and a front portion, wherein said front portion is disposed forward of said back portion whereby said front portion is intermediate said combustion chamber back portion and an interior of a room in which the fireplace is located when installed;

a flue positioned for exhausting the products of combustion;

a low density ceramic duct, positioned intermediate said combustion chamber and said flue, for extending the exhaust travel path of the products of combustion to promote additional combusting of unburned products of combustion, said ceramic duct comprising a products of combustion inlet, a products of combustion outlet, and at least one circuitous passageway connecting said inlet and said outlet; and a second ceramic duct for removing products of combustion from the front portion of said combustion chamber, said second ceramic duct positioned forward of said at least one circuitous passageway.

13. A fireplace for combusting fuel comprising:

a combustion chamber whereat the fuel is combusted and products of combustion are created, said combustion chamber further comprising an opening through which combustion air is introduced and a width having a central portion and lateral portions, wherein the products of combustion generally have a different heat content at the central width portion than at the lateral width portions, wherein said combustion chamber comprises a back portion and a front portion, wherein said front portion is disposed forward of said back portion whereby said front portion is intermediate said combustion chamber back portion and an interior of a room in which the fireplace is located when installed;

a flue positioned for exhausting the products of combustion;

a ceramic duct, positioned intermediate said combustion chamber and said flue, for extending the exhaust travel path of the products of combustion to promote additional combusting of unburned products of combustion, said ceramic duct comprising a products of combustion inlet, a products of combustion outlet, and a plurality of horizontally spaced and longitudinally extending passageways connecting said inlet and said outlet and segregating the products of combustion, whereby the products of combustion from the central width portion of said combustion chamber enter at least one of said passageways and are thereby segregated from the products of combustion from the lateral width portions of said combustion chamber that enter other of said passageways; and a second ceramic duct for removing products of combustion from the front portion of said combustion chamber, said second ceramic duct positioned forward of said plurality of horizontally spaced and longitudinally extending passageways.

* * * * *